US007252026B2

(12) United States Patent
Kempski et al.

(10) Patent No.: US 7,252,026 B2
(45) Date of Patent: Aug. 7, 2007

(54) STRAND OSCILLATOR ASSEMBLY FOR CHOPPERS AND METHOD

(75) Inventors: Douglas James Kempski, Holland, OH (US); Randall Clark Bascom, Wauseon, OH (US)

(73) Assignee: Johns Manville, Denver, CO (US)

( * ) Notice: Subject to any disclaimer, the term of this patent is extended or adjusted under 35 U.S.C. 154(b) by 79 days.

(21) Appl. No.: 11/175,610

(22) Filed: Jul. 6, 2005

(65) Prior Publication Data

US 2007/0006696 A1 Jan. 11, 2007

(51) Int. Cl.
*B23D 25/12* (2006.01)

(52) U.S. Cl. ..... 83/347; 83/913

(58) Field of Classification Search ..... 83/343, 83/346, 347, 348, 913; 65/452, 191.6, 475, 65/480, 500, 536; 226/92, 179, 91, 192; 242/615, 615.2

See application file for complete search history.

(56) References Cited

U.S. PATENT DOCUMENTS 3,268,955 A * 8/1966 Burnet et al. ..... 19/240
3,771,701 A * 11/1973 Brunk et al. ..... 226/91
3,815,461 A * 6/1974 Genson ..... 83/347
3,869,268 A * 3/1975 Briar et al. ..... 65/452
4,048,861 A * 9/1977 Woidke et al. ..... 226/192
4,083,279 A 4/1978 Wester et al. ..... 83/347
4,175,939 A * 11/1979 Nakazawa et al. ..... 65/452
4,249,441 A 2/1981 Sturtz ..... 83/347
4,287,799 A 9/1981 Fujita et al. ..... 83/347
4,344,786 A * 8/1982 Symborski et al. ..... 65/480
4,347,071 A 8/1982 Willis et al. ..... 65/536
4,398,934 A * 8/1983 Willis et al. ..... 65/480
4,551,160 A * 11/1985 Frailey et al. ..... 65/480
5,970,837 A 10/1999 Arterbum et al. ..... 83/552
6,267,035 B1 * 7/2001 Bascom et al. ..... 83/346
6,453,704 B2 * 9/2002 Arterburn et al. ..... 65/475
6,979,971 B2 * 12/2005 Takamune et al. ..... 318/632

* cited by examiner

*Primary Examiner*—Stephen Choi
(74) *Attorney, Agent, or Firm*—Robert D. Touslee

(57) ABSTRACT

An improved oscillator assembly that can be used on a chopper for chopping strands of fiber and other long or continuous it items into segments. The improved oscillating assembly moves the items back and forth across the surface of a working layer of the chopper while also rotating a guide roll for the item(s). The improved oscillating assembly uses separate motors to rotate the guide roll and to provide the oscillation and has reduced maintenance than prior art devices. The motor for moving the guide roll is a servo motor and is controlled with a programmable controller. Th3 invention reduces maintenance and increases the uniformity of wear on the chopping blades or cutting roll blade. The controller of the servo motor is programmed to provide dwell time at the reversing points.

12 Claims, 5 Drawing Sheets

STRAND OSCILLATOR ASSEMBLY FOR CHOPPERS AND METHOD

The present invention includes an oscillator assembly for oscillating rapidly moving items as the items run into all kinds of choppers. Each item can be a single fiber, filament, string, wire or ribbon, or each strand can contain a plurality of fibers, wires, ribbons or strips.

Choppers for separating long lengths or continuous items into short segments of various desired lengths are known as evidenced by various patents including U.S. Pat. Nos. 4,048,861, 4,398,934, 4,175,939, 4,347,071, 5,970,837. These choppers have a blade roll comprising a plurality of blades, each with a sharp edge, spaced apart around the periphery, a backup roll and some also have an idler roll. The idler roll runs against the backup roll the nip acts to hold the items being chopped It is known to oscillate the items being chopped back and forth to move the items back and forth along the cutting edge of the blades to attempt to lengthen the blade life, i.e. the running or chopping time of the blades in either time or in pounds of items chopped. When the blades become dull, the items are not completely chopped resulting in what is called "double cuts", "triple cuts" and "stringers" (long incompletely chopped items). These longer than desired and incompletely chopped items result in defects in the products made from the chopped items, e.g. nonwoven fibrous mats, and cause costly results including scrap, more frequent downtime to replace the blade roll, and decreases in productivity. However, on choppers having idler rolls that use a high force to press running items against the working surface of a backup roll, oscillating the items being chopped has not resulted in as much added blade life as expected and desired and the reason has been elusive for many years.

SUMMARY

The reason why the oscillation of the strand guide in the past, on choppers having an idler roll forcefully pressing against the running strands and the working surface of the backup roll, has not been nearly as effective as possible has now been discovered. The reasons are one or both of 1) that the strands of rapidly moving items had always been directed in a manner to contact the backup roll at or very near, i.e. within about 0.25 inch of the nip between the backup roll and the idler roll, and 2) the oscillation speed was too fast, not allowing time for the running strands to complete the oscillation prior to being contacted with a blade on a blade roll or contacting edge on a cutter roll. In this document the use of the term "blade" is intended to include a contacting edge on a cutter roll. Either one of these reasons limited the amount of oscillation and the best results are achieved when both of these reasons are addressed in the manner described below, or their equivalents. It has now been discovered that if the oscillating guide roll is located such as to make the rapidly moving items strike the peripheral surface of the backup roll at least about 0.75 circumferential inch or more upstream of this nip and more typically at least 1 or more circumferential inches, the oscillation will be much more effective in evening out the wear along the blade edges and lengthening the life, running time and pounds of items, of the blades in the blade roll. In this document the word "strands" means two or more of items, the items being fiber, filament, wire, string, ribbon or tape, and combinations of one or more of the items. This would include one or more strands of fibers such as glass fibers, and one or more wires, one or more strands of polymer fibers, and so on.

The invention comprises an oscillator assembly for moving one or more rapidly moving long or continuous items selected from a group consisting of fiber, filament, wire, string, strip, ribbon and strand back and forth in a direction generally perpendicular to the direction of the rapidly moving item(s), the oscillator comprising an item roll guide having a plurality of parallel, spaced apart grooves on its periphery, a motor for slowly rotating the roll guide, the motor being mounted on a platform having wheels, a reciprocating cylinder connected to the platform, a servo motor for driving the reciprocating cylinder and a control system for the servo motor. Typically, but not necessarily, the oscillator assembly also comprises a biasing member for maintaining the reciprocating cylinder under a bias throughout its reciprocating cycle to avoid backlash, prevent dwelling at the reversing points in its path or cycle, and also the use of a servo motor to drive the oscillation and a program for operating the servo motor, the program having the property of changing the speed of oscillation at the reversing points in the oscillation path. Most typically, the program stops the servo motor at the reversing points and pauses or permits the servo motor to remain still for several seconds, at least 5 seconds and more typically for 10 seconds or longer, even 30 seconds or longer, or until the running items have stopped moving laterally in the nip between the working surface and the idler roll. The dwell can be even longer, but it shouldn't be much longer or the wear will be excessive on the blades at the ends of the movement.

The invention also comprises a method of using the oscillator assembly for a strand guide in the process of chopping the long or continuous items in a chopper comprising a blade roll and a backup roll. Typically, but not necessarily, the chopper also has an idler roll whose periphery is in contact with the periphery of the backup roll and the items being chopped during operation. When used on choppers having an idler roll, the oscillator assembly is located such as to direct the running items onto the surface peripheral surface of the backup roll at a location at least about 0.5 inch upstream of the nip between the idler roll and the backup roll, more typically at least about 0.75 inch and most typically at least about 1 inch upstream of the nip. Most typically, the oscillator assembly has a servo motor and the servo motor that is operated such that the oscillator pauses for at least 5 seconds at two locations in the oscillating path, those locations being where the strand guide is stopped prior to reversing the direction of the movement of the strand guide.

The idler roll assembly 22 is also useful on choppers that do not have an idler roll to replace prior art oscillating assemblies. The use of the combination of the servo motor 50 and a programmable controller permits optimization of uniformity of wear of the chopping blades or a cutter roll. Also, the use of an electric ball and screw cylinder permits a more uniform wear pattern, and the use of a bias to maintain tension in one direction on the guide roll prevents springback at the turnarounds in the oscillating path.

When the word "about" is used herein it is meant that the amount or condition it modifies can vary some beyond that stated so long as the advantages of the invention are realized. Practically, there is rarely the time or resources available to very precisely determine the limits of all the parameters of one's invention because to do so would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors' disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term "about" as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

DETAILS

Figure 1:
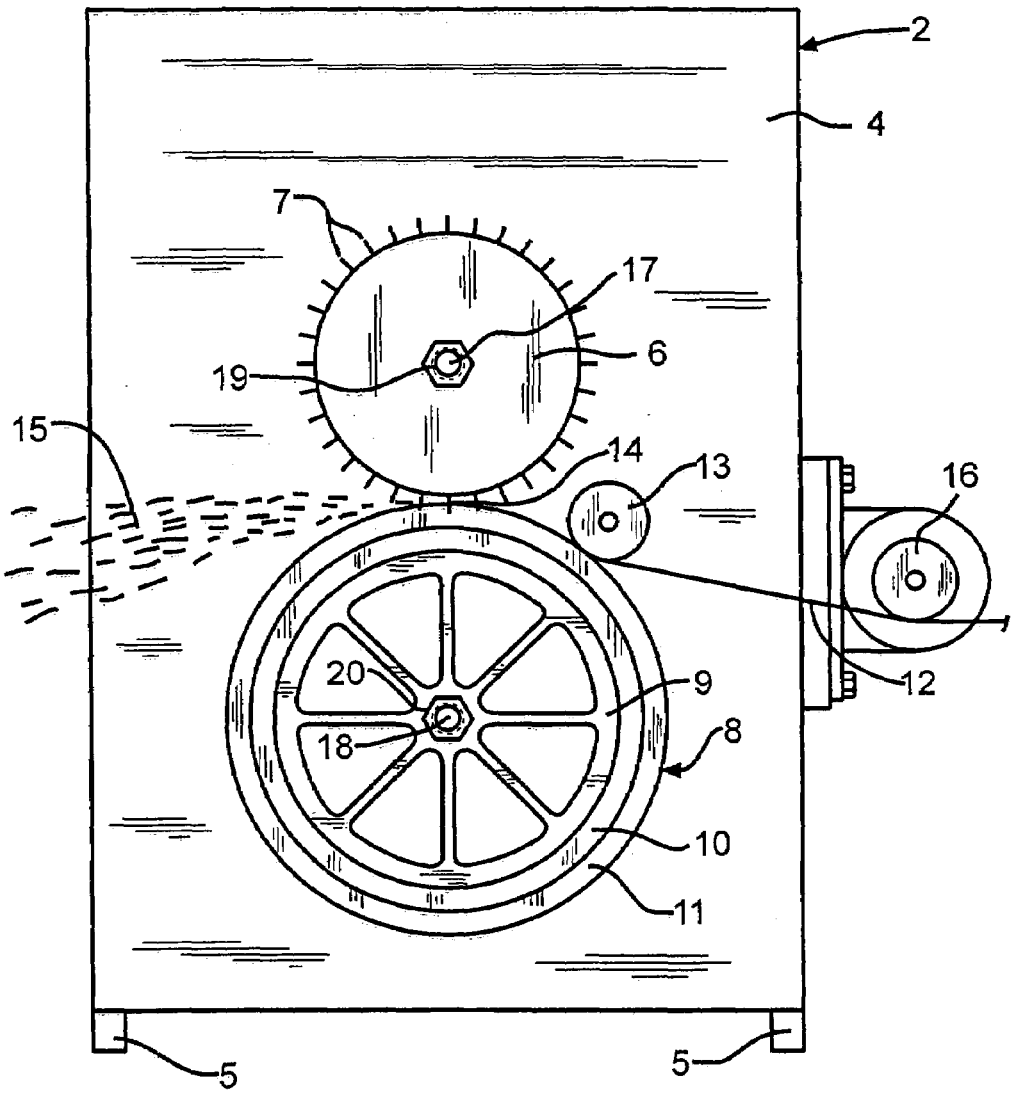
FIG. 1 PRIOR ART
FIG. 1 is a front view of a typical prior art chopper and prior art item oscillator.

FIG. 1 shows a front elevation view of a typical chopper 2 used in making chopped strand glass fiber. It comprises a frame and front plate 4, feet 5, a blade roll 6 with spaced apart blades 7 contained in slots and projecting from the periphery of a blade holder integrated into the blade roll 6, a backup roll 8 and an idler roll 13. The blade roll 6 is mounted on a rotatable spindle 17 and held in place with a large nut 19. The blade roll 6 is usually made of metal and thermoplastic material such as the blade rolls shown in U.S. Pat. Nos. 4,083,279, 4,249,441 and 4,287,799, the disclosures of which are herein incorporated by reference. U.S. Pat. No. 4,175,939, teaches a reciprocating guide roll for guiding strands of fiber onto a backup roll, but the assembly for providing the reciprocating the guide roll does not rotate the guide roll and thus the life of the guide roll is substantially reduced and downtime and labor is necessary to replace the worn guide roll.

The backup roll 8 is comprised of a hub and spoke assembly 9 with an integral metal rim 10 on which is cast or mounted a working layer 11 of an elastomer or thermoplastic material such as polyurethane. The backup roll 8 is mounted on a second spindle 18 and held in place with a large nut 20. To operate the spindle 18 of the backup roll 8 is moved towards the spindle 17 of the blade roll 6 until the blades 7 of the blade roll 6 press into the working layer 11 of the backup roll 8 a proper amount forming a nip 14 to break or separate fiber strands 12 into an array of short lengths.

One or more, usually eight or more and up to 20 or more strands 12, such as glass fiber strands, each strand containing 400-6000 or more fibers and usually having water and/or an aqueous chemical sizing on their surfaces, are pulled by the backup roll 8, in cooperation with a knurled idler roll 13, into the chopper 2 and the nip 14. The strands 12 first run under a grooved oscillating, separator and guide roll 16, preferably with one or two strands in each groove, and upward and over the outer surface of the backup roll 8. The working surface of the back up roll 8 is typically wider than the oscillating path of the glass fiber strands 12. The strands 12 then pass under the outer knurled surface of the idler roll 13, which is pressed against the strands at a desired pressure to enable pulling of the glass fiber strands. The strands remain on the surface of the working layer 11 and next pass into the nip 14 between the backup roll 8 and the blade roll 6 where they are separated with the razor sharp blades 7 wherein the strands are usually cleanly cut or broken into an array of chopped strand 15 having the desired length.

Oscillator assemblies for oscillating item(s) back and forth to try to move the item(s) back and forth along the cutting edge of the blades on the chopper are known, but suffer deficiencies that gave rise to the invention. At least one of the known oscillator assemblies did not move the item(s) far enough, others suffered excessive dwell or lash-back at the reversing points of their cycles. These and others did not provide adequate flexibility of adjustment and/or required excessive maintenance. Finally, the location of the prior art oscillator assemblies, particularly the item guide roll, was found to be substantially removed from the optimum location to provide optimum or near optimum blade life.

Figure 2:
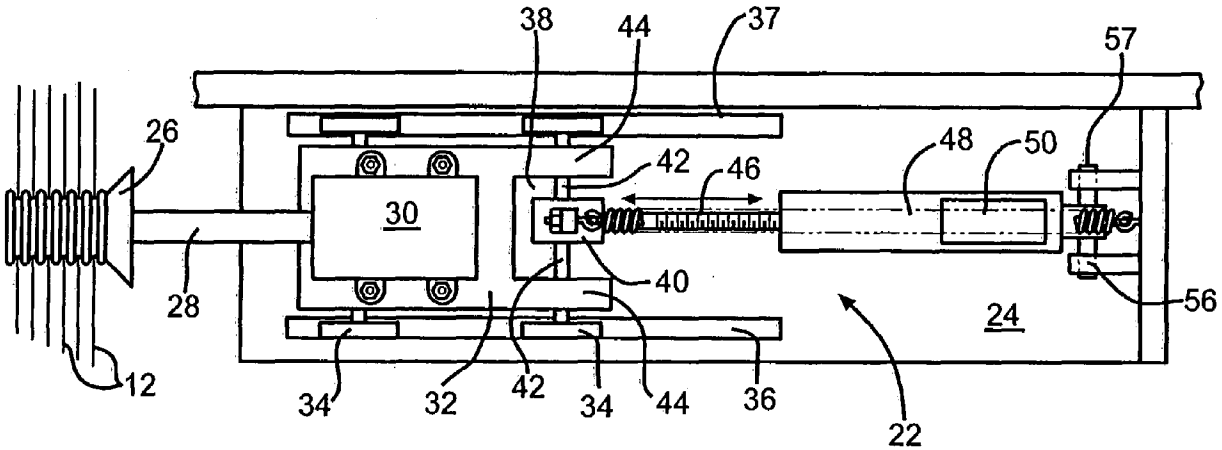
FIG. 2 is a plan view of one typical embodiment of the oscillator assembly of the invention.
Figure 3:
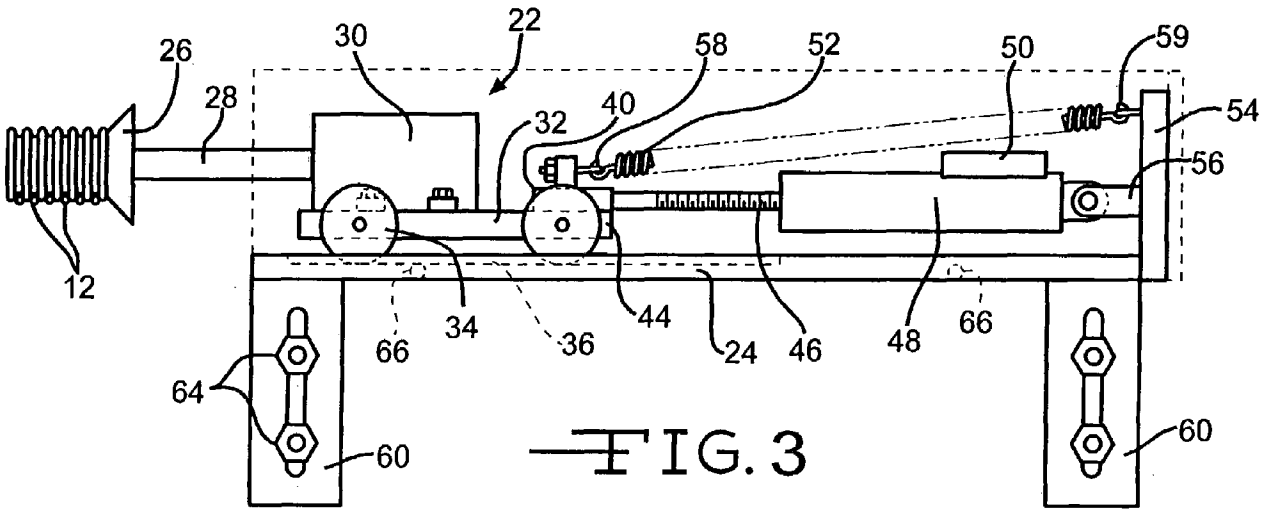
FIG. 3 is a front view of the oscillator assembly shown in FIG. 2.

An embodiment of the oscillating assembly of the invention is shown in FIGS. 2 and 3. FIG. 3 is a plan view and FIG. 2 is a front view. The oscillator assembly typically sets on a base plate 24 and is comprised of a roll guide 26 that is mounted on a shaft, most typically a rotatable shaft 28 driven by a motor 30, most typically a gear set or gear motor, that very slowly rotates the guide roll 26 in a known way to optimize the life of the guide roll 26. Guide rolls are sometimes called separator rolls in the industry. Regardless of how the shaft 28 is mounted or driven, it is connected directly or indirectly to a movable table 32, in this embodiment the motor 30 is mounted on the movable table 32. The movable table 32 is fitted with wheels 34 that are free wheeling. Typical speeds of rotation for the shaft 28 are in the range of about 1-3 RPM, and most typically the direction of rotation is counter to the direction of the moving strands. In this embodiment 4 wheels 34 are installed near each corner of the table 32, but fewer, or more, than 4 wheels could be used. The free wheeling wheels 34 are guided by guides or a track of any suitable kind to run back and forth in a straight line, in this embodiment by a slot shaped track 36, with or without an optional slot shaped track 37, depressed in the base plate 24 and that aligns with at least one of the wheels 34. The slot shaped depression(s) 36,37 can be of any significant depth, but usually a depth of at least 0.1 inch is sufficient with a depth of about 0.12 being more typical. Typically when only one slot shaped track 36 is used, the wheels on the opposite side, or the location of the axels on the other side, are sized or located to keep the top of the table 32 level during its reciprocal path.

In this embodiment, an end of the table 32 opposite the end closest to the guide roll 26 is U shaped, having an opening 38 therein for a clevis 40 pivotly secured to the table 32 with a rod or bolt 42 whose axis is most typically on the same plane as the axis of the wheels 34, or the centerline of the guide roll shaft 28. The rod or bolt 42 is secured to protruding opposed ears 44 protruding from the table 32 on opposite sides of the opening 38. Most typically the ears 44 are part of the table 32, but need not be. A cylinder rod 46 is attached to the clevis 40, the cylinder rod being a part of a reciprocating device, in this embodiment an electrically driven ball and screw cylinder 48 driven by an electric motor 50. Most any kind of reciprocating mechanism including a rack and pinion, fluid cylinder, eccentric drive, electric ball and screw drive and equivalents thereof can be used to drive the table 32 and guide roll 26 back and forth. The electric ball and screw drive 48,50 shown here is an Industrial Devices Corp., Model # EC2X-20-05B-150-MP2-FT1M-PB-SIE21X unit. This unit is capable of a reciprocating movement of about 150 mm, but not all of that is utilized. The amount of movement will depend upon the number of items being chopped and the width of the blades 7 in the blade roll 6. A typical blade width (cutting edge) is about 4-8 inches and a typical reciprocating distance with when using these blades is about plus and minus 1-3 inches from the center of the blades. The cylinder end of the ball and screw cylinder 48 is attached, typically pivotly attached, to a frame member 54 such as with a clevis 56 and a rod or pin 57. The frame member 54 can be part of the base plate 24 or can be a separate bracket, etc., most typically attached to the base plate 24. An optional cover 65, shown in phantom lines, is most typically held in place in any customary manner, such as with one or more bolts 66, to prevent liquid overspray and the item(s) typically present near the oscillator assembly 22 during operation from entering the works of the oscillator assembly 22.

Figure 9:
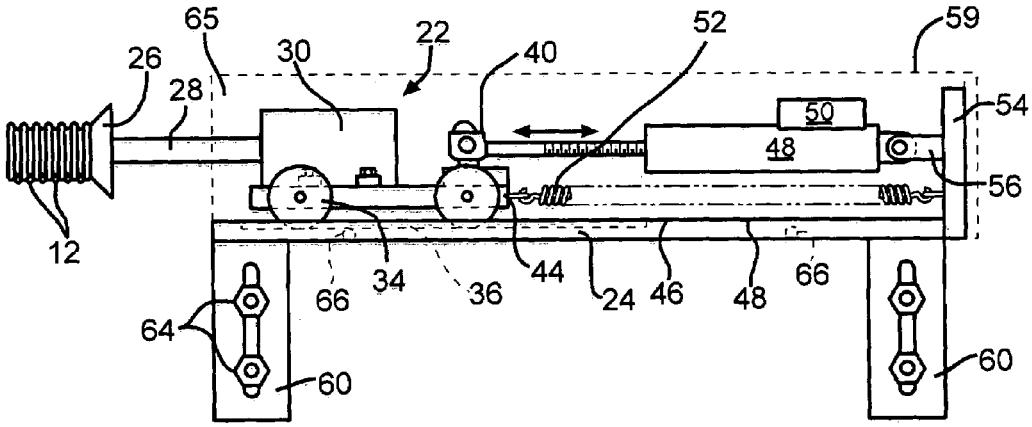
FIG. 9 is a front view of another embodiment of an item oscillator assembly of the invention.

FIG. 9 shows another embodiment of the oscillator assembly of the invention. This embodiment is like the embodiments described above except that the positions of the biasing spring 52 and the electric screw cylinder 48, cylinder rod 46 and motor 50 are switched so that the axis of the spring 52 is aligned with the axis of the wheels 34 and the axis of the cylinder rod 46 is vertically spaced above the biasing spring 52. In this embodiment the clevis 40 for the rod end of the cylinder rod 46 is mounted vertically on top of the table 32 and the opening 38 in the table 32 is not necessary. This embodiment tends to exert a vertically downward force on the table 32 that tends the table 32 from moving vertically upward during operation.

An optional biasing means is most typically used to prevent uneven movement or lash back at the reversing points, i.e. the point in the cycle where the table 32 is deaccelerated, stopped and accelerated in the opposite direction. Due to slack in the parts, made worse with wear, a jerking action will often occur in the reversing process unless a biasing mechanism is used. In the embodiment shown in FIGS. 2 and 3, a coil spring 52 is mounted with one end 58 of the spring attached indirectly or indirectly to the table 32 or the clevis 40 and the other end 59 attached to the vertical wall 54 or to the cylinder end clevis 56. The spring 52 is selected such that it is under significant tension at both ends of the reciprocating travel path of the table 32 and the rod-end clevis 40. This is important to preventing a smooth transition in direction of movement at both reversing points.

Figure 4:
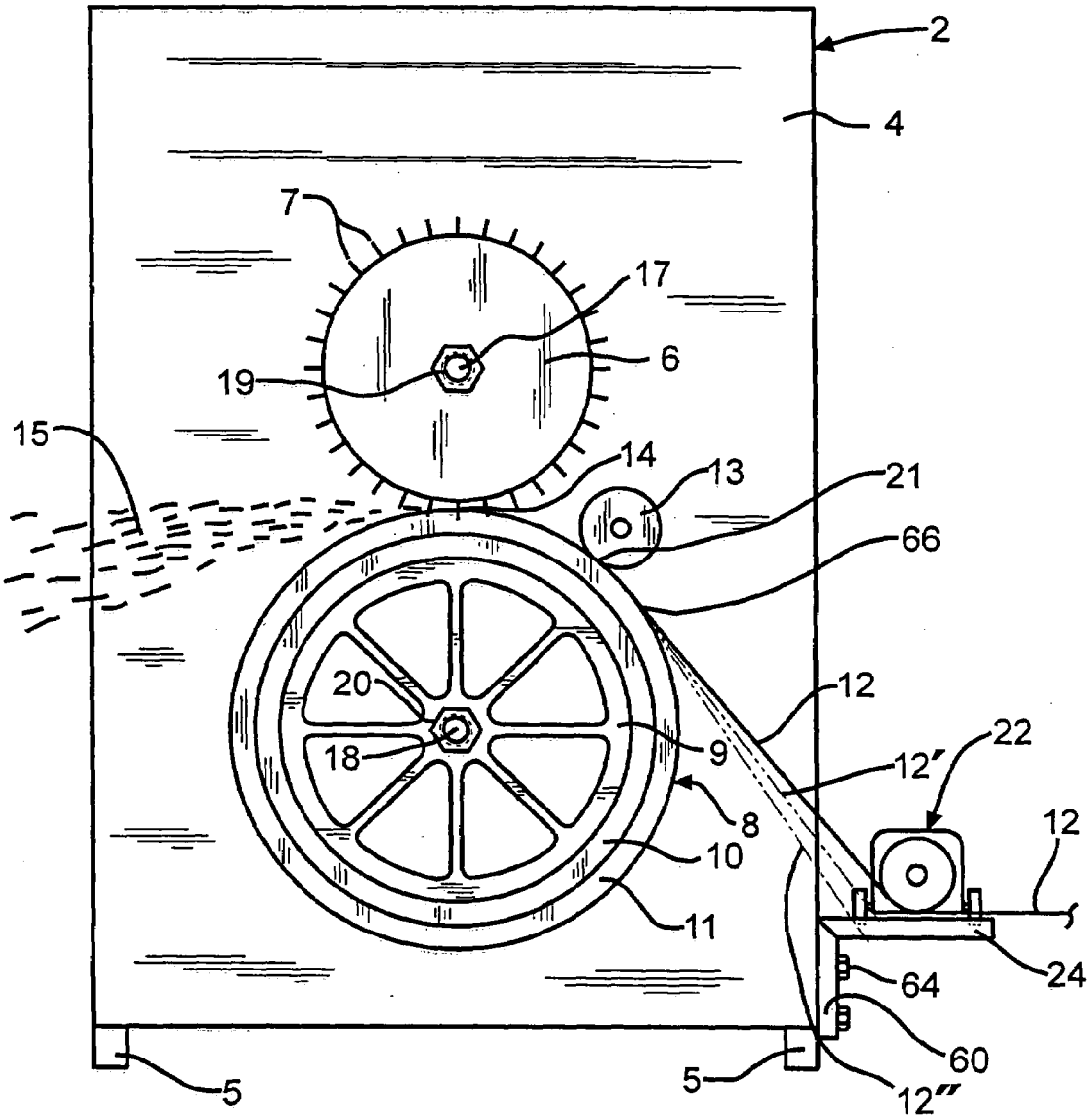
FIG. 4 is a front view of a chopper having the oscillator assembly of the invention installed in a manner to make the oscillator assembly most effective in extending the life of the chopper blades.
Figure 5:
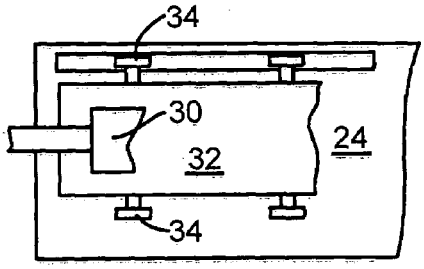
FIGS. 5-8 are partial plan views of other embodiments of the invention.
Figure 6:
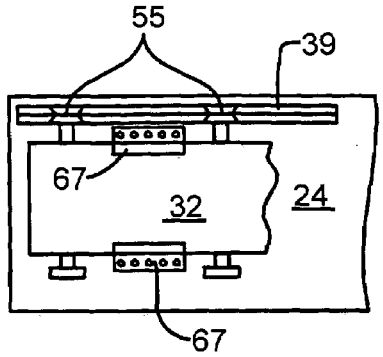

FIGS. 5-8 are partial plan views of other embodiments of the oscillator assembly 22. FIG. 4 shows an optional guide setup for the table 32. A single slot depression 35 in the plate 24, or C channel profile 35 mounted on top of the plate 24, is used on at least one side, typically the chopper side, of the base plate 24 to guide one set of wheels 34. When the slot 35 is used, the wheels 34 on the opposite side of the table 32 are most typically larger in diameter to keep the top of the table 32 level. When a C frame 35 is used, the sides of the C frame need be only about 0.1-0.5 inch high, but can be higher if desired. FIG. 6 shows a different guiding track 39 having a triangular cross section and in this embodiment the wheels 55 have a V shaped cross section, like V-belt pulleys, to fit over the guiding track 39. This embodiment also shows an optional feature that can be used in one form or another on all the embodiments, and that is one or more modified Z shaped hold-down members 67. The modification to the Z is that the slant-vertical portion is vertical, with the bottom ear attached to the table 32 as shown, and the top ear extending just above the top of the table 32 to prevent the adjacent edge of the table from lifting upward away from the plate 24. These can be angle shaped members, as shown, with sliding contact with the top surface of the table 32, or can have a small clearance less than the distance that would permit the wheels 34 or 55 to escape their guide means. As will be obvious, many different types of known hold-down devices can be used such as wheels, spring biased wheels, etc.

Figure 7:
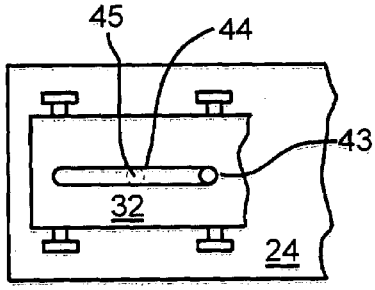

FIG. 7 shows another optional guiding system in which one or more vertical guide pins 43, 45 mounted on the top surface of the table 32 and long enough to extend into an elongated slot 41, elongated in the direction of the reciprocating movement. The diameter of the pins 43,45 should be almost as wide as the slot 41 and can be a low friction material like nylon or Teflon®, or at least having a low friction working surface inside the slot 41. An optional nut or fastener (not shown) attached to the top of the pin 43 or the pin 45, or to each pin, having its lower surface close relationship or in slight contact with the top surface of the table 32 would act as an optional hold-down.

Figure 8:
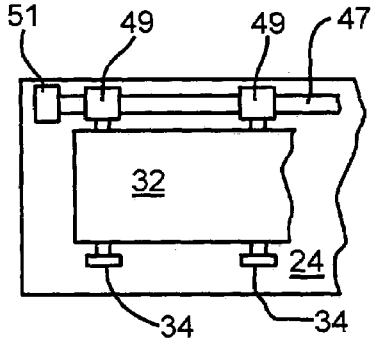

FIG. 8 shows an optional combination guide and hold-down system for the table 32. In this embodiment a guide rod 47 is mounted above the top of the base plate 24, using a mount 51 attached to the base plate 24, on one or both sides of the movable table 32 and spaced from the movable table 32. One or two collars 49, attached to one side of the movable table 32 surround the guide rod 47 sufficiently to provide a guide throughout the reciprocating path of the movable table 32 and optionally, sufficient to also act to prevent the table 32 from moving more than about 0.1 inch vertically.

As shown in FIGS. 4 and 9, the base plate is mounted as close to the upstream side of the chopper 2 as is practical and is most typically mounted right on the side of the chopper 2. This is accomplished in the embodiment shown with vertical mounting bracket(s) 60, each bracket having a vertical slot 62 therein to permit vertical adjustment of the base plate 24, particularly the vertical location of the guide roll 26, on the chopper 2. FIG. 4 shows the oscillator assembly 22 mounted on the chopper 2, in this case using bolts 64 threaded into threaded holes in the upstream side of the chopper and a chopper frame member (not shown). The vertical placement of the guide roll 26 is critical to good lateral, reciprocal movement of the items on the peripheral surface of the working layer 11. This placement should be such that the items being chopped contact the peripheral surface 11 at least about 0.5 inch, more typically at least about 0.75 circumferential inch and most typically at least about 1 inch upstream of the nip 21 between the idler roll 13 and the working layer 11. This means that the item(s) being chopped travel at least about 0.5 circumferential inch before reaching the nip 21. In the embodiment shown in FIG. 4, the location 66 where the items 12 to be chopped first contact the surface of the working layer 11 is at least 2-3 circumferential inches upstream of the nip 21. The item(s) 12 can be made to contact the surface of the working layer further upstream, i.e. greater than 4 circumferential inches by lowering the oscillator assembly 22 with respect to the nip 21, see the phantom lines 12' and 12". To maintain the guide roll 26 at a comfortable working height off the floor, if necessary the chopper 2 is raised further off the floor by lengthening the legs 5 or by placing the chopper on a platform, or by effectively rotating the chopper counterclockwise by raising the upstream end of the chopper more than the downstream end.

Figure 10:
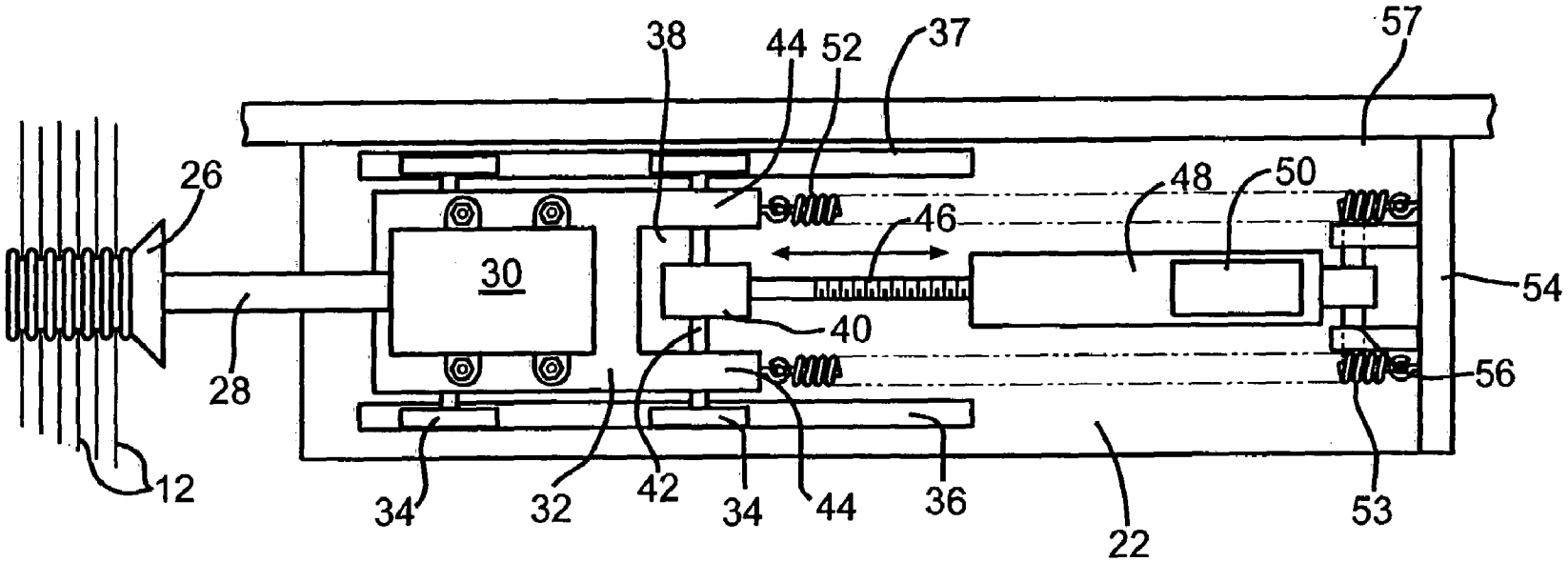
FIG. 10 is a plan view of the embodiment shown in FIG. 9.

The embodiment shown in FIG. 10 differs from the embodiment shown in FIGS. 2 and 3 only in the location and number of biasing springs. In this embodiment two biasing springs 52, 53 are used with one biasing spring being on each side of the cylinder 48. This set up permits more room for the electric servo motor 50 and keeps the table 32 more stable over its reciprocating path. Though not necessary, most typically the axis of the springs 52, 53 are both in alignment with the axis of the shafts on the wheels 34 and the axis of the cylinder rod 46.

In operation, a programmable controller runs the electric servo motor 50. The program is variable during the reciprocating cycle of the clevis 40 at the end of cylinder rod 46. In the most typical program, the electric servo motor 50 runs at a constant speed, when it is running, throughout the oscillating cycle, but the motor is paused at the ends, turn around points, of the oscillating cycle. As mentioned above, in the past the oscillating cycles used did not allow the strand guide 26 to pause for a substantial time at the turnaround points (two) in the cycle. The prior art had to cause the strand guide 26 to pause at each end, it was essential to reversing direction, but the pause was only instantaneous. In the present invention, the servo motor 50 is paused for at least 5 seconds at each turnaround point, usually longer such as at least 10 seconds with 30 seconds or more being more typical, to allow the strands 12 to move a maximum amount in the nip between the idler roll 13 and the working surface 11 of the backup roll 8, before the servo motor 50 is restarted to move the strands 12 in the opposite direction. This produces a substantial increase in the uniformity of blade wear and a substantial increase in blade life.

Most typically a controller is used to control the item oscillator or oscillator assembly for the strand guide, particularly the servo motor 50. The first parameter is the distance the strand guide is moved past a center point of its oscillating path in opposite directions, or plus or minus directions, from the center point. Most typically, this will be the maximum allowed by either the width of the blade, the width of the working surface or both. For example, for if the sharpened edge of the blade is 3.65 inches, that dimension is inserted into the controller and the controller will move the guide roll back and forth 1.6325 inches on either side of the center point of the oscillating path. The second parameter is the location of the center point of the oscillating path. The operator can insert the circumferential centerline of the working surface of the backup roll as the center point, or can offset the center point from the circumferential centerline of the working surface in either direction a desired amount. The next parameter is the incremental distance of movement of the oscillating assembly each time the motor 50 is energized, e.g. 6 mm, or more or less. The next parameter is the time intervals between the starting of the motor 50, i.e. if 60 seconds is entered, the oscillating assembly will move the strand guide 6 mm every 60 seconds. This time interval is a matter of choice, and should be sufficiently long to allow the items to move the maximum distance in the nip between the idler roll and the working surface and/or items being chopped. Most typically the time interval and speed of the servo motor 50 is set to travel about 25 mm in 30 seconds. The last parameter is the length of the delay at each turnaround point, most typically 30 seconds, more or less. Ideally, the pause is long enough to allow the running items to move laterally as far as they will move in the nip between the working surface 11 and the nip roll 13. Any significant longer dwell there will cause excessive wear on the blades at the ends of the oscillation path and any significant shorter dwell will fall short of optimizing the uniformity of wear, and the life, of the blades 7. However, if the life of the blades 7 is not at least twice the life of the working surface 11, it may not be necessary to completely optimize the life of the blades 7 because the cost of stopping

The invention claimed is:

1. A chopper for separating one or more rapidly moving items selected from a group consisting of fiber, filament, strands, string, wire, strip, and ribbon into short segments comprising a blade roll, a working surface on a backup roll for the blade roll to work against an idler roll for forceably pressing the one or more items against the working surface close to a nip between the blade roll and the working surface, a guide roll for guiding the one or more items, a shaft for supporting the guide roll, and an assembly for oscillating the guide roll back and forth along its axis, the improvement being that the oscillating assembly comprises a mechanism for translating a rotational motion into an oscillating lateral motion of said shaft in directions parallel to an axis of said shaft, an electric servo motor for providing the rotational motion and a programmable controller for said servo motor, the oscillating assembly located to guide the items onto the working surface at least about 0.75 circumferential inch upstream of a nip between the idler roll and the working surface and wherein the programmable controller is programmed to cause the servo motor to pause for at least 5 seconds at reversing points in the oscillating path of said shaft.

2. The chopper of claim 1 wherein the mechanism for translating rotational motion into lateral motion for the said shaft is a ball and screw cylinder.

3. The chopper of claim 2 wherein the guide roll is biased in one direction during the entire oscillating path.

4. The chopper of claim 3 wherein the oscillating assembly also comprises a table that at least partially supports the ball and screw cylinder and the shaft for the guide roll.

5. The chopper of claim 4 wherein the table is supported with one or more wheels or guides, or both.

6. The chopper of claim 5 wherein the oscillating assembly comprises a plate comprising a slot or a guide member for guiding the one or more wheels or guides.

7. The chopper of claim 5 wherein the oscillating assembly is positioned to guide the one or more items into contact with the working surface at a location that is at least one circumferential inch upstream of a nip between the idler roll and the one or more items.

8. The chopper of claim 2 wherein the oscillating assembly also comprises a table that at least partially supports the ball and screw cylinder and the shaft for the guide roll.

9. The chopper of claim 8 wherein the table is supported with one or more wheels or guides, or both.

10. The chopper of claim 9 wherein the oscillating assembly comprises a plate comprising a slot or a guide member for guiding the one or more wheels or guides.

11. The chopper of claim 2 wherein the oscillating assembly is positioned to guide the one or more items into contact with the working surface at a location that is at least one circumferential inch upstream of a nip between the idler roll and the one or more items.

12. The chopper of claim 1 wherein the oscillating assembly is positioned to guide the one or more items into contact with the working surface at a location that is at least one circumferential inch upstream of a nip between the idler roll and the one or more items.

* * * * *